United States Patent [19]

Brischoux

[11] Patent Number: 4,940,253

[45] Date of Patent: Jul. 10, 1990

[54] SAFETY BINDING

[75] Inventor: Jean-Claude Brischoux, Seynod, France

[73] Assignee: Salomon S.A., Annecy cedex, France

[21] Appl. No.: 156,821

[22] Filed: Feb. 17, 1988

[30] Foreign Application Priority Data

Feb. 18, 1987 [FR] France ..... 8702596

[51] Int. Cl.[5] ..... A63C 9/085

[52] U.S. Cl. ..... 280/629; 280/634

[58] Field of Search ..... 280/611, 623, 625, 626, 280/629, 630, 634

[56] References Cited

U.S. PATENT DOCUMENTS

| | | | |
|---|---|---|---|
| 3,350,110 | 10/1967 | Salomon | 280/630 |
| 3,794,339 | 2/1974 | Smolka | 280/612 |
| 3,826,509 | 7/1974 | Smolka | 280/612 |
| 3,947,051 | 3/1976 | Sittmann | 280/611 |
| 4,372,574 | 2/1983 | Svoboda et al. | 280/634 |
| 4,398,747 | 8/1983 | Bernard et al. | 280/630 |
| 4,589,673 | 5/1986 | Dimier et al. | 280/630 |

FOREIGN PATENT DOCUMENTS

| | | | |
|---|---|---|---|
| 2415957 | 10/1975 | Fed. Rep. of Germany . | |
| 2634649 | 2/1978 | Fed. Rep. of Germany . | |
| 2919266 | 11/1980 | Fed. Rep. of Germany . | |
| 3017841 | 11/1981 | Fed. Rep. of Germany . | |
| 1454511 | 8/1966 | France . | |
| 0089533 | 5/1967 | France . | |
| 2375880 | 7/1978 | France . | |
| 2395046 | 2/1979 | France | 280/630 |
| 2418657 | 9/1979 | France . | |
| 2424040 | 11/1979 | France . | |
| 2481938 | 11/1981 | France . | |

*Primary Examiner*—Charles A. Marmor
*Assistant Examiner*—Tamara L. Finlay
*Attorney, Agent, or Firm*—Sandler, Greenblum & Bernstein

[57] ABSTRACT

A safety binding for a ski boot which includes a jaw adapted to retain a portion of the boot and to release under the effects of a force greater than a predetermined release threshold wherein the jaw is moveable between a stable equilibrium position and a release position in which the jaw releases the boot. The binding further includes an energization assembly which includes an elastic return device, such as a spring, for exerting a force on the jaw to bias the jaw into the stable equilibrium position; a shock absorber; and a compensation mechanism for varying the release threshold as a function of the intensity and duration of force whereby under the effect of a soft force. The release threshold is defined mainly by (1) the initial energization of the elastic return such that the shock absorber will not substantially change the compression of the spring, and (2) under the effect of a violet force, i.e. a brief force, the release threshold will increase because of the reaction of the shock absorber which opposes the compression of the spring, wherein such an increase in the release threshold is limited by the initial energization of the spring, increased by the additional energization that the shock absorber produces in the spring via the compensation mechanism.

50 Claims, 8 Drawing Sheets

SAFETY BINDING

BACKGROUND OF THE INVENTION

1. Field of the Invention

The present invention relates to safety bindings for skis, adapted to maintain, in a releasable fashion, one portion of a boot with respect to a ski.

2. Description of Background and Relevant Information

Safety bindings normally comprise at least one jaw adapted to retain a portion of a boot and to free it when subjected to excessive force exerted at the level of the leg of the skier. The jaw is movable, with respect to a fixed binding base, between a stable equilibrium position or rest position, and a released position in which the jaw frees the boot portion. In its movement from the stable equilibrium position towards the released position, the jaw, moved by the boot, is displaced against the force exerted by an energization assembly, the energization assembly tending then to assure the return of the jaw into the stable equilibrium or rest position. It is thus necessary to furnish a certain degree of energy to attain the release of the binding, i.e., its displacement to bring it into the release position.

In the most commonly used embodiments, the energization assembly is constituted by a prestressed spring. The release is obtained as soon as a predetermined force is reached. It is known that a spring acts in the same manner when it is subjected to a brief force or to a long force of the same amplitude. Thus, for such conventional bindings, the release threshold is the same whatever the duration of the force. The only factor which modifies the release threshold is the inertia of the mechanical elements which are made to move, which is most often negligible.

Yet, it is known that a leg can resist an elevated force of high amplitude if the duration of the force is brief. On the other hand, a force of low amplitude for an extended duration can be dangerous, for example in a slow fall. Thus, with a binding having only springs, the user is required to adjust the release threshold to a lower value or amplitude which is safe for a longer duration. However such bindings are not capable of withstanding high but acceptable forces of short duration, thus permitting early unnecessary or premature release.

It has appeared advantageous to design bindings in which the release threshold varies as a function of the duration of the force, the threshold being higher for brief forces and being lower for longer forces. It has been proposed, for example in French Pat. No. 1,454,511, to associate a fluid shock absorber with the principal spring of the energization means, positioned in parallel. In such an apparatus, when the force is slow, i.e., when the speed of displacement of the jaw is relatively slow, the shock absorber has a negligible frictional force relative to the return force exerted by the spring, and the release threshold is determined by the spring itself. On the other hand, when the force is brief, the speed of displacement of the jaw is substantial, and the resistance opposed by the shock absorber adds to the return force exerted by the spring, causing an increase in the energy necessary for release and in the force which must be applied on the jaws during release. Such a device has a major disadvantage, however, because the shock absorber has an infinite resistance when the speed of displacement of the jaw is very substantial in certain limited situations, i.e., when the force is a shock.

A similar solution was proposed in French Pat. No. 2,424,040, in which the spring is likewise in parallel with a shock absorber so that the extent of compression of the spring and that of the shock absorber are identical. In the event of a brief force being exerted, for example in the case of a brutal shock, the shock absorber produces a very elevated release threshold, which is in theory infinite.

It is likewise known to position a release spring and a shock absorber in series. Such a solution is proposed, for example, in German Pat. No. 2,634,649. In this case, if the shock absorber blocks up during a violent shock, the release threshold is raised, but the spring can still compress.

The disadvantage of this design is that it is necessary to equip the shock absorber with a return spring, which is at least as strong as the principal spring, in a manner so as to equilibrate the pressure of the principal spring in the rest position. In effect, it is necessary to prevent the principal spring from compressing the shock absorber at the end of its extent in the absence of the bias force. This poses a constructional problem which is all the more complex because it is necessary to be able to vary the prestress of the principal spring depending upon the performance of the skier.

Another disadvantage of this construction is that it is difficult in practice to determine the effect of the shock absorber on the principal spring, because the shock absorber is directly in series with the principal spring.

SUMMARY OF THE INVENTION

The present invention is directed to a safety binding for a ski boot having a jaw adapted to retain and to release a portion of a boot under the effects of a force greater than a predetermined release threshold wherein the jaw is movable between a stable equilibrium position and a release position in which the jaw releases the boot; an energization assembly including an elastic return element, such as a spring, for exerting a force on the jaw to bias the jaw to the stable equilibrium position and a shock absorption element, such as a shock absorber, wherein the energization assembly also includes a compensation means for varying the release threshold as a function of intensity and of duration of the force, to permit the return means and the shock absorption means to act in parallel to define the release and return conditions of the jaw under the effect of a soft force, while under the effect of a brief force to permit the return means to exert an increasing force on the jaw. Preferably the compensation means is a transverse compensation element oriented generally transverse to the direction of the longitudinal component of movement of the return element and the shock absorption element.

In the safety binding, as described above, the jaw is movable with respect to a fixed element, such as a base, and the return element includes at least one principal spring, and the binding preferably also includes a movable element, such as a shaft, moved by the jaw as said jaw pivots, wherein the principal spring is positioned between the fixed element and the movable element.

In addition, the safety binding, as described above, preferably also includes at least one abutment adapted to cooperate with the transverse compensation element to define a transverse limiting orientation of the compensation means, preferably wherein the compensation means is elastically biased towards the limiting orientation against the return energy of the principal spring, such that the compensation member remains in the transverse limiting orientation under the effect of a soft force, and leaves its support position against the abutment means, in rotation, under the effect of a brief force to increase the deformation of the principal spring and the return force that the principal spring exerts on the jaw.

In the safety binding, as described above, a first end of the shock absorption means as well as a first end of said principal spring are connected to the fixed element, while a second end of the shock absorption means or shock absorber is journalled to a first journal point on said transverse compensation element, the transverse compensation element is pivotable relative to a second end of the principal spring at a second journal point, and the movable element is pivotably journalled at a third journal point relative to the transverse compensation element, preferably wherein a first end of the shock absorber is also connected to the movable element, and a first end of the principal spring is biased against the movable element, while a second end of the shock absorber is journalled to a first journal point of the transverse compensation element which is pivotable relative to a second end of the principal spring at a second journal point, and the fixed element is journalled at a third journal point relative to the transverse compensation element.

In a safety binding as described above, the transverse compensation element may be pivotably mounted on an intermediate support on the fixed element at a journal point, preferably wherein the fixed element also includes an abutment to limit rotation of the transverse compensation element in a direction that the transverse compensation element follows under the effect of the return force of the principal spring, wherein the intermediate support may be fixed in position or adjustably positioned on the fixed element of the energization assembly, preferably wherein the intermediate support is a ramp, adapted to vary the effect of the shock absorber as a function of the rotation of the transverse compensation element, mounted on an adjustment element for transversely adjusting the effect of the shock absorber.

In the safety binding, as described above, the shock absorber has one end secured to a fixed element, and another end pivotally secured to an intermediate transverse element which is pivotally secured with a movable element adapted to move with the jaw, wherein the return means is a principal spring adapted to bias the jaw and the transverse compensation element to a normal operating position, preferably wherein the intermediate transverse element includes a first ramp, and the principle spring is biased between a fixed element and the first ramp through a second ramp located on the principal spring to bias the intermediate transverse element into its normal operating position.

In one embodiment of the safety binding as described above, the return means is a principal spring, and the principal spring and the shock absorber are supported against a fixed element, wherein an opposite end of the principal spring and the shock absorber are pivotably associated with a transverse intermediate element, and the ski binding preferably also includes a movable element adapted to move with the jaw, wherein the movable element is in pivotable relationship with the transverse intermediate element, such that the moveable element, the transverse intermediate element and the principal spring are positioned so that a force exerted on the jaw is transmitted to the principal spring and the shock absorber through the transverse intermediate element, preferably wherein the movable element is a first plate including an inclined surface or ramp and a flat surface, and wherein the principal spring is associated with the transverse intermediate element through a second plate including an inclined surface or ramp and a flat surface, whereby a portion of the transverse intermediate element is generally positioned between each of the flat surfaces in the normal operating condition of binding.

In accordance with the safety binding as otherwise described above, the return means is a principal spring and the binding further includes an adjustment element for adjusting the prestress in the principal spring.

The safety binding, as described above may also include a transverse intermediate element extending between the shock absorber and the return element, and an abutment to define a limiting transverse orientation of the transverse intermediate element, wherein the transverse intermediate element and the abutment are longitudinally adjustable to adjust prestress in the principal spring when the binding is in a normal operating position.

The movable element of the safety binding as otherwise described above, may be secured to the jaw by a linkage element of adjustable length whereby adjustment of the length of the linkage element adjusts the prestress of the return element.

In one embodiment of the safety binding, as described above, the return element is a principal spring, the principal spring and the shock absorber means transmit force exerted on the movable element in parallel to and from the compensation means which preferably is a compensating element pivotably mounted on a fixed element, and wherein the compensating element is biased against an abutment by the principal spring.

In a safety binding, as otherwise described above, the movable element is a shaft having one end associated with the jaw which is biased by the return element, wherein the compensation means is pivotally secured to an end of the shaft opposite to the jaw and is biased into a normal operating position by the return element, in addition to being pivotally secured to the shock absorber to exert a force on the shock absorber in response to a longitudinal displacement of the shaft against the bias of the return element, preferably wherein the compensation means is biased towards the normal operating position through first and second ramps, for example wherein the return element is a principal spring biased between the fixed element and a first plate, and the compensation means extends between the first plate and a second plate associated with the movable element, such that the pressure exerted by the first plate and second plate on the compensation means is sufficient to maintain the compensation element in a normal operating condition, preferably wherein the first plate includes an incline forming a first ramp, and the second plate includes an incline forming a second ramp, and each of the first plate and second plate includes a flat intermediate surface adapted to press against the compensation element whereby exertion of a brief force on the movable element aligns the compensation element along the first ramp and the second ramp.

In another embodiment of the safety binding as otherwise described above, the safety binding is a rear step-in binding having a casing and the compensation member is a transverse compensating element pivotably secured to the return means, the shock absorption means and the casing of the binding at three separate pivot points of pivotal attachment, wherein the transverse compensating element is pivotably secured to the casing at a point between the points of pivotable attachment to the return means and the shock absorption means, wherein the return means is a principal spring having one end secured to the transverse compensation element, and another end secured to a spur in sliding contact with an exterior ramp pivotably mounted on the casing, preferably wherein the spur is adapted to exert a force on a movable element secured to the shock absorber at an end opposite to a point of pivotable attachment of the shock absorber to the transverse compensating element.

The present invention is also directed to a safety binding for a ski boot including a jaw adapted to retain a portion of a boot, and to liberate the portion of a boot under the effects of a force greater than a predetermined threshold, wherein the jaw is movable between a stable equilibrium position and a release position in which the jaw liberates the boot; and an energization assembly including an elastic return member and shock absorber which is adapted to vary the release threshold as a function of the intensity and duration of the force, wherein the return member and the shock absorber are associated through a compensation means; whereby under the effect of a soft force the return member and the shock absorber act in parallel to define release and return conditions of the jaw, while under the effect of a brief force the return member and the shock absorber act in series and parallel so as to increase a return force exerted by the return member on the jaw.

BRIEF DESCRIPTION OF THE DRAWINGS

Other characteristics and advantages of the present invention will become clear from the following description given by way of non-limiting example only in which: -

FIGS. 13 to 15 illustrate bindings similiar to the bindings shown FIGS. 9 and 10; wherein FIG. 13 illustrates the binding in a normal position for skiing;

FIG. 14 illustrates the binding of FIG. 13 in a state resulting from a sudden force of a ski boot:

FIG. 15 illustrates the fixation of FIG. 13 following a soft force exerted by the boot;

DESCRIPTION OF PREFERRED EMBODIMENTS

Figure 1:
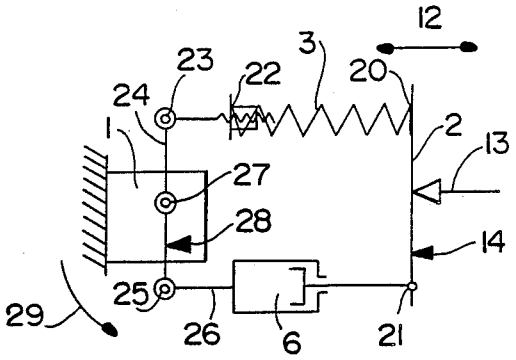
FIG. 1 is a schematic diagram illustrating the structure of the energization assembly according to the present invention in a first embodiment, in a stable equilibrium or rest position.

The present invention has in particular as an objective to provide a binding having elastic return means and shock absorption means which together present a variable release threshold as a function of the duration of the force, in which the release threshold remains less than the limiting release threshold reached in the event of a sudden shock, the limiting release threshold having a finite predetermined value. Furthermore, under the effect of a slow acting force, the shock absorption means do not substantially modify the mechanical characteristics of the binding, i.e., the release threshold, which is practically defined by the single principal elastic return means.

Another objective of the invention is to provide an energization assembly structure having a high facility of adjustment of the release threshold.

Another object of the invention is to provide a design in which it is possible to predetermine the influence of the shock absorption means on the principal elastic return means without substantially modifying the release threshold during a slow force situation.

To achieve these objects as well as others, the elastic means and the shock absorption means are associated, in the energy assembly, by linkage means such that:

under the effect of soft forces, i.e., producing a sloW relative displacement of the jaw, the energization assembly reacts as an apparatus in which the elastic return means is in parallel with the shock absorption means, such that, if the force is very slow, the elastic means alone determines the release threshold;

under the effect of violent forces, i.e., producing a relatively rapid displacement of the jaw, the energization assembly reacts as a shock absorber in series with an apparent elastic element whose rigidity is greater than the rigidity of the elastic means, such that the release threshold is increased and that its maximum value, achieved for a brief impulse, is finite and determined by the apparent elastic element.

Thus, according to the invention, the binding comprises a jaw adapted to retain a portion of the boot and to free it under the effect of a force greater than a predetermined threshold. The jaw is movable, with respect to a fixed element such as a base, the jaw causing in its movement the movement of a movable element such as a shaft, or a rocker, against an energization assembly. The assembly comprises on the one hand elastic return means constituted by at least one principal spring positioned between the fixed element and the movable element, and on the other hand shock absorption means serving to vary the release threshold as a function of the duration and the intensity of the force. The jaw is movable between a stable equilibrium position and a released position in which it frees the boot portion. The first end of the shock absorption means is connected to one of the two elements fixed or mobile, referred to as the first element. A first end of the principal spring is connected to the first element, and the second end of the shock absorption means is journalled at a first journal point of a transverse compensation element or bar.

The second end of the principal spring is journalled at a second journal point of the transverse compensation element. The other of the two fixed or mobile elements, called the second element, is journalled at a third journal point of the transverse compensation element. Abutment means cooperate with the transverse bearing and are positioned such that they define a limiting transverse orientation of the compensation bar, the compensation bar being elastically returned towards the limiting transverse orientation under the effect of the return energy of the principal spring.

The apparatus is configured such that:

under the effect of a soft force, the compensation element remains in its limiting transverse orientation, and the shock absorption means act in parallel on the principal spring to define the release conditions and return conditions of the jaw; and under the effect of a violent force, the compensation element leaves its support against the abutment means and, as a result of this rotation, tends to increase the deformation of the principal spring and the return force that the principal spring develops on the jaw.

According to one embodiment, the compensation bar is pivotably mounted around an intermediate support affixed to the second element and forming the third journal point. An abutment affixed to the second element is provided to limit the rotation of the bearing to its limiting transverse orientation in the direction that it follows under the effect of the return force of the principal spring.

According to another embodiment, the second journal point of the compensation bar is formed of a first ramp of the compensation bar supported against a second ramp having a fixed direction affixed to the second end of the principal spring. In this embodiment, the first and second ramps are pressed against one another by the action of the principal spring and are shaped such that the principal spring tends to bring them back into a mutual orientation of stable equilibrium, thereby assuring the return of the compensation element towards its limiting transverse orientation. In this embodiment, the third journal point of the second element on the compensation element being a simple journal positioned in an intermediate position of the pivoting arm portion including the first ramp.

According to yet another embodiment, the second journal point of the compensation element is formed of a first ramp of the compensation element supported against a second ramp having a fixed direction affixed to the second end of the principal spring The first ramp and the second ramp are pressed against one another by the action of the principal spring and are shaped such that the principal spring tends to bring them to a mutual orientation of stable equilibrium so as to assure the return of the compensation element towards its limiting transverse orientation. The third journal point of the second element on the bearing is a third ramp provided on the bearing opposing the first ramp and cooperating in support on a fourth ramp having a fixed direction affixed to the second element. The third ramp and the fourth ramp are also pressed against one another by the action of the principal spring and are shaped such that the principal spring tends to bring the compensation bar to its limiting transverse orientation.

FIG. 1 schematically illustrates an energization assembly according to the invention. To simplify the explanation, the energization assembly is described herein as including means for energization positioned between a fixed element 1, such as a base, and a movable element 2. The movable element 2 is connected mechanically to a jaw of the binding, (not shown) which is movable with respect to the fixed element 1 to allow for the release. The means for energization, which are biased by movable element 2, include a principal spring 3, or helicoidal compression spring, and a shock absorption means 6, such as a conventional shock absorber, e.g. piston type.

In this embodiment, principal spring 3 is associated with shock absorption means 6 such that, during the exertion of a rapid force, the presence of the shock absorption means 6 increases the compression of principal spring 3. To accomplish this, the first end 20 of the principal spring 3 and the first end 21 of the shock absorption means 6 are affixed on movable element 2 of the energization assembly, subjected to the bias of the jaw shown by arrow 13. The second end 22 of principal spring 3 is journalled to the first end 23 of a compensation bar element 24 whose second end 25 is journalled to the second end 26 of the shock absorption means 6. The compensation bar element 24 is pivotably mounted around an intermediate axis 27 affixed to the fixed element, or intermediate support 1 of the energization assembly. An abutment 28, affixed to the fixed element of the energization assembly, is adapted to limit the rotation of compensation bar 24 in the direction of arrow 29, or the direction which it follows under the bias of principal spring 3. A fixed abutment 14 limits the displacement of the movable element 2 during the return to the rest position under the effect of principal spring 3.

In the rest position, shown in FIG. 1, compensation bar 24 is supported against abutment 28, and is oriented along the limiting transverse orientation. Movable element 2 rests against abutment 14. The movable element is guided by means for guiding (not shown) so as to assure the translational displacement along double arrow 12.

Figure 3:
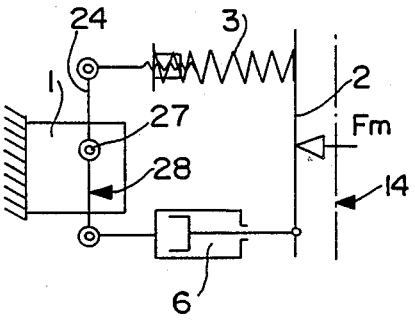
FIG. 3 illustrates the apparatus of FIG. 1 during a soft release force.

During slow forces of an amplitude D producing a release of the binding, the jaw slowly pushes back movable element 2 to reach the position shown in FIG. 3. During this displacement, the compensation bar 24 rests against abutment 28, in its limiting transverse orientation, such that spring 3 and shock absorption means 6 are in parallel and together determine the conditions of release and return of the jaw. When the movement is very slow, the shock absorption means 6 produces a negligible resistance relative to the force developed by principal spring 3. The force necessary for release is then equal to the force developed by principal spring 3, or minimal force Fm.

Figure 2:
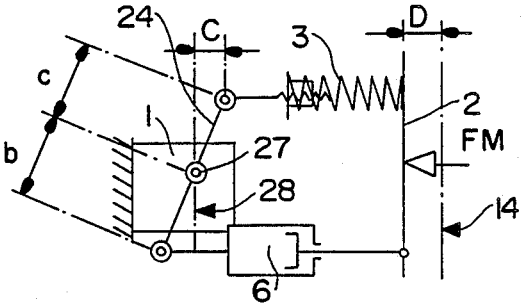
FIG. 2 illustrates the apparatus of FIG. 1 during a sudden release force.

FIG. 2 illustrates the state of the energization assembly during a very brief force of the shock type. In this case, the displacement of movable element 2 is very rapid, and the shock absorption means 6 is equivalent to a rigid mechanical linkage. Compensation bar 24, under the effect of this rigid linkage, pivots around its axis 27. The force F which is necessary to obtain this displacement of movable element 2 is thus considerably increased because the shock absorption means produces a reaction and by virtue of the fact that the principal elastic return means 3 is much more compressed. In this regard, the compression of the shock absorption means is equal to the displacement D of movable portion 2, increased by an extent C which is dependent upon the displacement D and of the ratio between the lengths c and b of the two portions of compensation bar 24 as shown in the Fig. The maximum force FM necessary to obtain the release is, however, of a finite value and is limited by the presence of the principal elastic return means 3.

For a force of medium duration, between a shock and a very long impulse, the force necessary to obtain the release follows a rule of decreasing variation as a function of the intensity and the duration of the bias. It is possible to vary the maximum value FM by displacing the rotation axis 27 laterally to render the lengths b and c unequal. A coming together of axis 27 towards the spring causes a reduction of FM, and a spacing produces an increase of FM.

Principal spring 3 simultaneously assures the return of the jaw and the return of the shock absorption means 6 towards the rest position. It is observed that one can easily adjust the prestress of the principal elastic return means 3, without modifying the action of the shock absorber 6, by simultaneously displacing abutment 28 and axis 27 to bring them together or to space them from abutment 14.

Alternatively, shock absorption means 6 has its own return means for returning the shock absorption means to the rest position, and the first end 21 of the shock absorption means simply rests against the movable element. On the other hand, the operation is unchanged during a force, which upon returning the principal spring 3 assures the return of the movable element 2, so that the end 21 of the shock absorption means 6 is returned to rest against movable element 2 by return means of shock absorption means 6

In the case of a rear binding, movable element 2 is, for example, constituted by a movable piston element or a rocker supported against a release ramp. Abutment 14 corresponds to the zone of the ramp which is in contact with movable element 2 in the normal skiing position. In the case of a front binding, movable element 2, is for example, a piston supported against a pivot axis, and abutment 14 represents the end position of the piston at rest.

Figure 4:
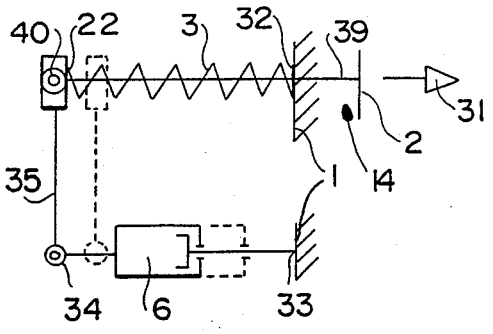
FIG. 4 illustrates a schematic diagram of the energization assembly structure according to a second embodiment of the invention, in the rest position and in the reaction position to a soft force.
Figure 5:
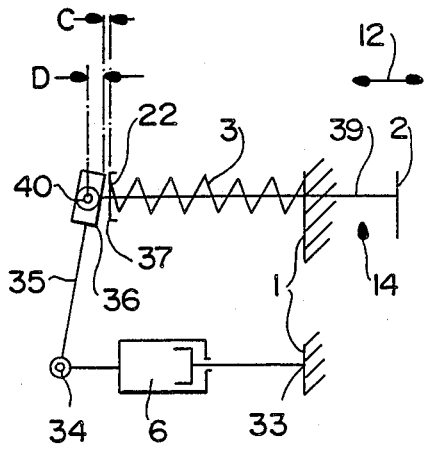
FIG. 5 illustrates the apparatus of FIG. 4 during a sudden force.

FIGS. 4 and 5 illustrate a second embodiment of the energization assembly according to the invention. In this embodiment, movable element 2 of the energization assembly is provided to operate in traction during release, as is shown by arrow 31. In this embodiment, the principal compression spring 3 is associated with a shock absorption means 6 in a manner such that, during sudden forces, the presence of the shock absorption means 6 increases the compression of the principal spring 3. For this, principal spring 3 and shock absorption means 6 have a first end, respectively, 32 and 33, affixed to the fixed element 1 of the energization assembly. The second end 34 of the shock absorption means 6 is journalled to the first end of a transverse pivotable compensation bar 35 whose second end includes a first ramp 36 positioned to face a second ramp 37 affixed to the second end 22 of the principal elastic return means 3, as shown in the Figs. Second ramp 37 is guided by means for guidance (not shown) by which the ramps are kept in a constant transverse orientation. The means for guidance is movable in translation along the direction of displacement of movable element 2, the direction shown by the double arrow 12. Movable element 2 is journalled mechanically, for example by a shaft or cable 39, to a portion 40 of pivotable compensation bar 35, the portion 40 being in the intermediate position with respect to the first ramp 36.

FIG. 4 shows in solid lines the state of the energization assembly in the rest position. Movable element 2 is supported against an abutment 14, towards which it is returned by the action of the principal spring 3. Compensation bar 35 is in a limiting transverse orientation, ramps 36 and 37 being pressed against one another in a mutual orientation of stable equilibrium. Under the effect of a soft release force, shown by arrow 31, the apparatus deforms itself and tends to adopt the state shown in dashed lines in FIG. 4. The displacement of movable element 2 is slow, and produces a simultaneous translation of pivotable compensation bar 35, the compensation bar remaining substantially parallel to itself during movement and causing the slow compression of the shock absorption means 6. For a very soft force, the action of shock absorption means 6 is negligible relative to the force caused by principal elastic return means 3.

On the other hand, as shown in FIG. 5, during a rapid force, shock absorption means 6 acts as a rigid mechanical linkage, causing the pivoting of pivoting compensation bar 35. During such a pivoting, the ramp 36 inclines itself with respect to the ramp 37, such that the compression of the spring is equal to the displacement D or extent of release increased by a complementary compression C induced by the inclination of the ramps towards one another, as is shown in FIG. 5.

In this embodiment, it also appears that one can adjust the prestress of the principal spring 3 without this adjustment modifying the effectiveness of shock absorption means 6; wherein the effectiveness of the shock absorption means can be optimized by appropriately shaping ramps 36 and 37. The effect of the shock absorption means 6 is limited, however, such that the maximum force FM necessary to obtain the release has a limited value, which is maximum during a sudden force of the shock type.

Figure 17:
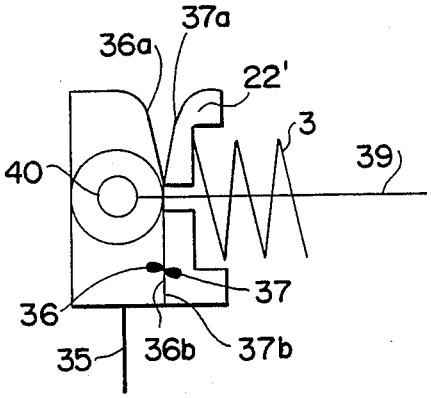
FIGS. 17 and 18 illustrate an alternative embodiment showing an enlarge second end of the compensation bar and the intermediate element.
Figure 18:
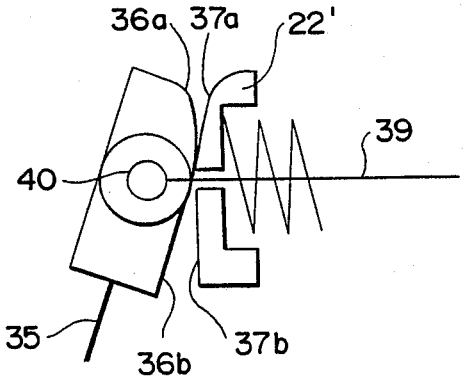

FIGS. 17 and 18 illustrate an alternative embodiment showing an enlarged second end of compensation bar 35 and of the intermediate element 22'. In these figures, ramps 36 and 37 which constitute the contact surfaces of compensation bar 35 and intermediate element 22' have curved upper ends 36*a* and 37*a*, respectively. This rounded off or curved portion permits modulation of the efficiency of the shock absorber on the spring. In this present case, the effectiveness is reduced, and for the same inclination of compensation bar 35, the complementary compression "C", induced by the shock absorber on the spring, is lower compared to the case in which ramps 36 and 37 are rectilinear, for example as shown in FIG. 4–5.

Preferably, in alignment of portion 40 of the pivoting compensation bar 35 and the axis of cable 39, ramps 36 and 37 define respectively zones or areas 36*b*, 37*b*, which are planar and perpendicular to the direction defined by cable 39. These zones correspond to a stable equilibrium position of the compensation bar, i.e., when zone 37*b* is in contact with zone 36*b*, the compensation bar is maintained in a limited stable orientation, in which it is perpendicular to cable 39. In particular, when the compensation bar is forced to bend in a natural manner under the effect of a force, for example as illustrated in FIG. 18, the compensation bar tends to come back to its stable limited orientation (FIG. 17), in which zones 36*b* and 37*b* will come into contact of each other.

Figure 6:
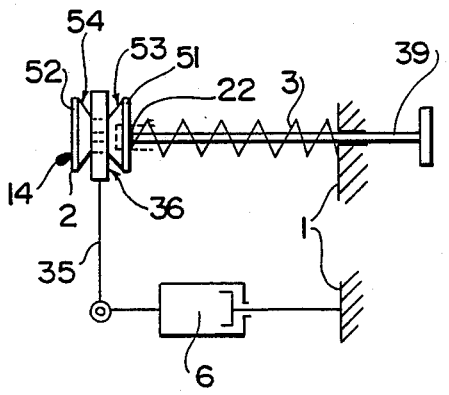
FIG. 6 illustrates an alternative embodiment of FIGS. 4 and 5.
Figure 7:
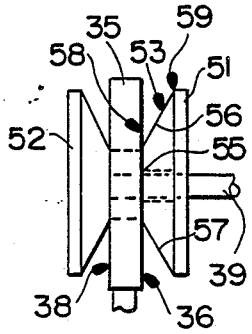
FIGS. 7 and 8 illustrate the operational detail of the embodiment of FIG. 6.
Figure 8:
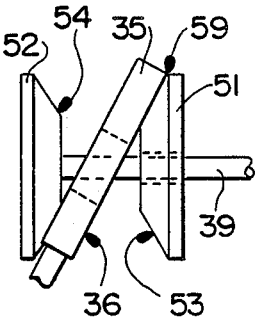

FIGS. 6–8 illustrate an alternative embodiment of FIGS. 4 and 5. The second end of pivoting compensation bar 35 is compressed between two plates 51 and 52, plate 51 being affixed to second end 22 of principal spring 3 and having, facing compensation bar 35, a ramp 53 which is similar to the ramp 37 of FIG. 5. Plate 52 constitutes movable element 2 of the energization assembly, and includes, facing pivoting compensation bar 35, another ramp 54. Cable 39 is affixed to plate 52, and it extends through the first end of pivoting compensation bar 35 and plate 51, such that plate 51 can slide along cable 39 following an inclination of compensation bar 35 (FIG. 8). The compensation bar includes, contact surfaces or ramps both sides, i.e. ramp 36 and ramp 38, respectively, cooperating with ramp 53 and ramp 54 as shown in the Figs. The ultimate pivoting of compensation bar 35 during sudden forces causes the spacing of plates 51 and 52 and a supplemental compression of principal spring 3.

FIGS. 7 and 8 illustrate an embodiment of plates 51 and 52 and of pivoting compensation bar 35, in which each plate, such as plate 51, includes a ramp 53 having a central surface 55 which is planar and bordered by two oblique or inclined surfaces 56 and 57, the compensation bar 35 having a single planar surface 36 facing ramp 53. At the beginning of pivoting of compensation bar 35, the relative rotation of the compensation bar on plate 51 occurs around a junction point 58 of ramp 53, causing a relatively slow supplemental compression of principal spring 3. As a result, the relative rotation occurs around end 59 of plate 51, such that the complementary compression of principal spring 3 increases more rapidly. Thus, by selecting in an appropriate manner the shape of the ramps, one can modulate the effect of the shock absorption means 6 on the principal spring.

Figure 9:
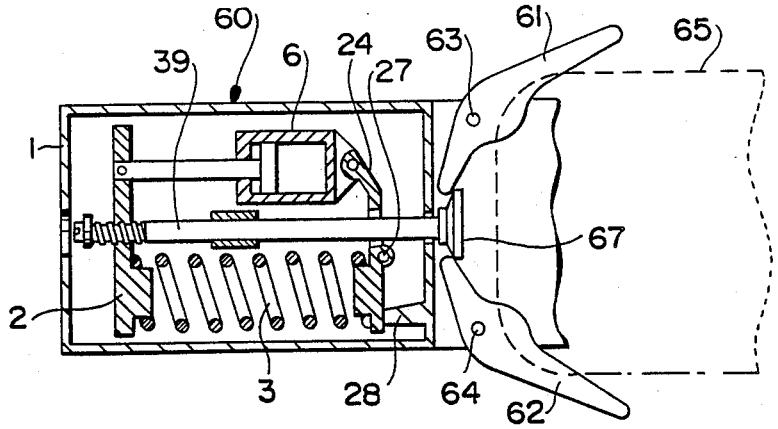
FIG. 9 illustrates, in the rest position, a front binding provided with an energization assembly according to the embodiment of FIG. 1.
Figure 10:
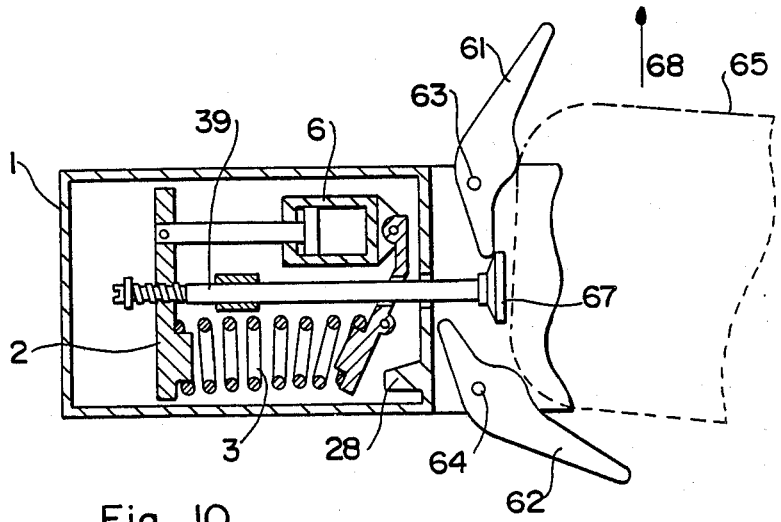
FIG. 10 illustrates the binding of FIG. 9 in the release position caused by a sudden force.

The previously described energization assemblies can be utilized, for example, on front bindings or rear bindings of skis. To illustrate these applications, FIGS. 9 and 10 illustrate a front binding having movable lateral wings. The binding comprises an energization assembly 60, and two lateral wings 61 and 62 which are respectively movable around vertical axes 63 and 64. Wings 61 and 62 are shaped to retain the front of a boot 65 shown in dashed lines. The energization assembly 60 conforms to the embodiment of FIGS. 1–3, with similar elements being identified by the same numerical references. Movable element 2 is connected to wings 61 and 62 of the jaw by a rod 39 which ends in a head 67 being gripped on the interior ends of wings 61 and 62 as is seen in the Fig. Compensation bar 24 pivots around the intermediate axis 27, and comes to abut against abutment 28, its ends being respectively affixed to principal spring 3 and shock absorption means 6, whose other ends are affixed to the movable element 2. FIG. 9 illustrates the binding in its state of rest, while FIG. 10 illustrates the binding in a released state, in which lateral wing 61 is pivoted to allow for the disengagement of boot 65 as is shown by arrow 68. The state of the energization assembly shown in FIG. 10 is the state which results from a sudden force of the shock type.

Figure 11:
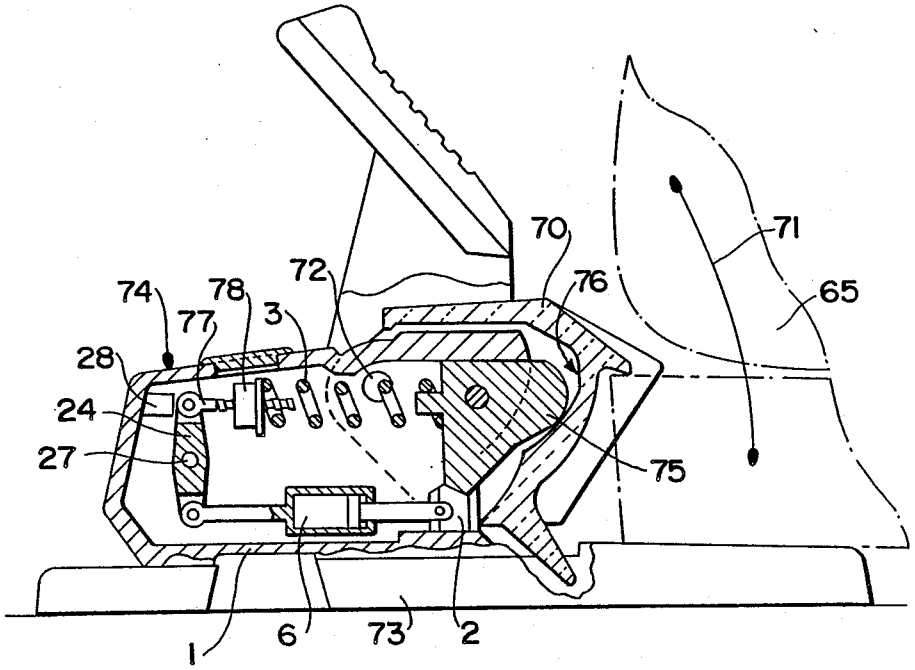
FIG. 11 illustrates schematically a side view of a rear abutment provided with an energization assembly according to the invention.

FIG. 11 illustrates a rear binding whose jaw 70 is adapted to pivot, as is shown by double arrow 71, around a horizontal transverse axis 72 which is itself affixed to base 73 of the binding. Jaw 70 is shaped to fasten on the ski the rear end of the sole of a ski boot 65 schematically shown in dashed lines. Jaw 70 is biased by an energization assembly 74, which comprises a movable element 2 sliding in longitudinal translation in body 74 of the binding forming the fixed element 1, the movable element 2 being shaped as a spur 75 to cooperate with a ramp 76 of the jaw, as shown in the Fig. During pivoting of jaw 70 upwardly, ramp 76 pushes movable element 2 towards the rear. The energization assembly is of the type described in reference to FIGS. 1–3, with a principal spring 3, a transverse compensation bar 24 journalled on an intermediate fixed axis 27, a fixed abutment 28, a shock absorption means 6, with similar elements being identified by the same numerical references.

Figure 13:
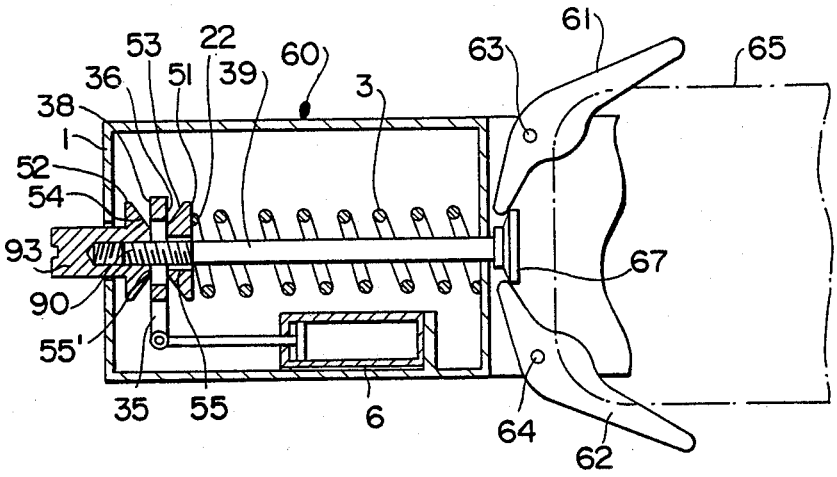
Figure 14:
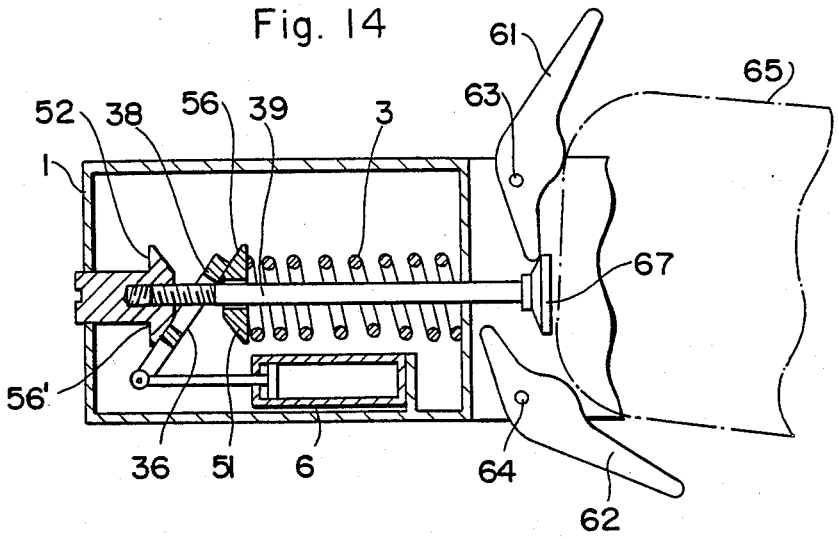
Figure 15:
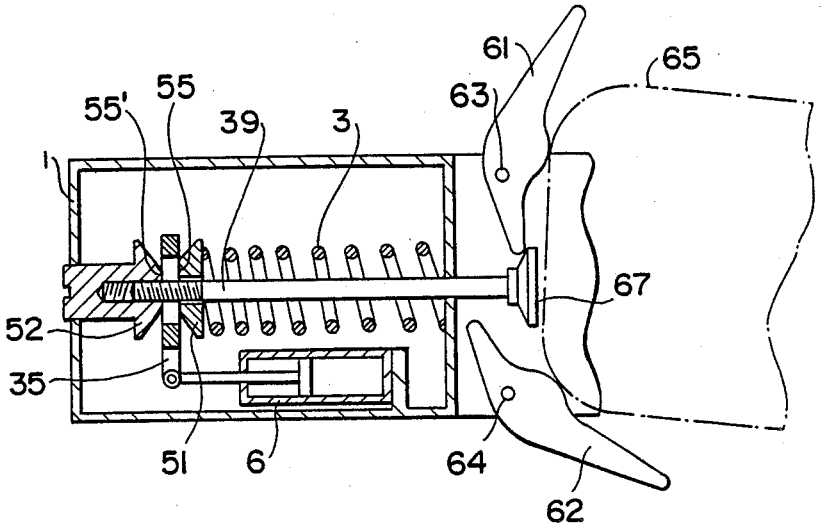

FIGS. 13 to 15 illustrate a front binding of the same type as the binding shown in FIGS. 9 and 10, which includes two lateral wings 61 and 62 similar to the previous ones and an energization assembly 60. The assembly 60 conforms substantially to what has been described relating to FIGS. 6 to 8, and the same references have been used to designate the same elements.

FIG. 13 illustrates the binding in a normal position for skiing. In this position, central zones 55, 55′ of the plate ramps 52 and 51 come in contact with ramps 38 and 36 of compensation bar 35. This position defines a stable equilibrium orientation for the compensation bar.

FIG. 14 illustrates the binding of FIG. 13 in a state resulting from a sudden force of the boot or shoe 65 on wing 61. This force induces the drawback of cable shaft or rod 39 and a compression of spring 3 corresponding to the displacement of plate 52. An additional compression resulting from the reaction of the shock absorber 6 which acts as a rigid element supplements this first compression. Compensation bar 36, therefore bends so as to force plates 51 and 52 to become spaced apart from each other. It is this relative spacing that causes an additional compression of the spring. In a case of a violent force, the release threshold is determined by the compression of the spring resulting from the displacement of plate 52, corresponding to the displacement of rod 39, increased by the additional compression resulting from the related spacing of plates 51 and 52.

In the position shown in FIG. 14, zones 56 and 56′ incline or are recessed with respect to zones 55, 55′ of plates 51, 52 which come in contact with ramps 36 and 38 of compensation bar 35. The shape given to those zones 56, 56′ thus allows an adjustment of the effect of shock absorber 6 on spring 3 and, in the present case, to diminish this effect with respect to what it would be if zones 56 and 56′ were in the extension of central zones 55, 55′.

When the effect of the force ends, spring 3 and rod 39 return to their original position as shown in FIG. 13. The shock absorber has not moved to any appreciable extent and the drawback of the cable toward its state of rest is more powerful in view of the additional compression which it produces.

FIG. 15 illustrates the fixation of FIG. 13 following a soft force exerted by the boot on jaw 61. In this embodiment, the shock absorber opposes a negligible resistance to the compression of the spring. Therefore, the spring is compressed and compensation bar 35 is maintained it its stable equilibrium position by the contact of zones 55 and 55′ of plates 51 and 52 with faces 36 and 38 of compensation bar 35. The binding threshold release is herein defined by the only compression of the spring resulting from the displacement of plate 52.

FIG. 14 and 15 also illustrate limited reactions of the shock absorber, following a violent force and a soft force. In this regard, FIG. 14 illustrates the maximum threshold release and FIG. 15, the minimum threshold release.

In other cases, the threshold release is between the previously described minimum and maximum threshold releases. A shock absorption effect can be obtained with a limitation of the maximum threshold release to a maximum value.

Figure 16:
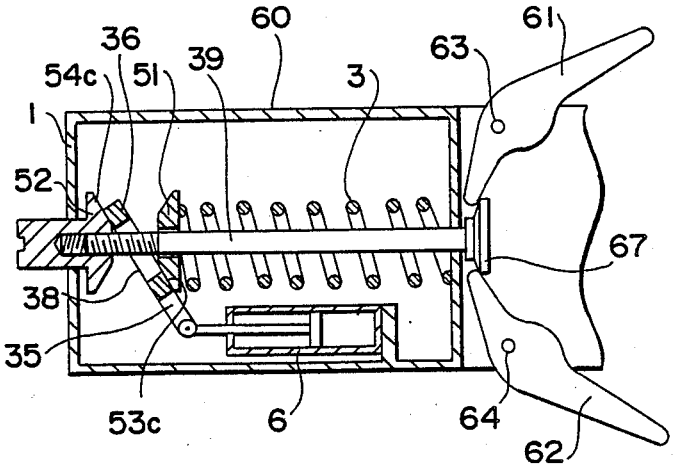
FIG. 16 illustrates the return a biased jaw of the binding under the effect of a soft force.

FIG. 16 illustrates the return of the biased wing 61 under the effect of a soft force, which alternately can be considered the releasing of the boot, or the recentering of the boot on the ski. In this embodiment the rod 39 returns to its original position, but the shock absorber, which previously shortened, opposes a resistance as the shock absorber returns to a state of rest as shown in FIG. 15. Compensation bar 35 then swings to a direction opposite the direction shown in FIG. 14 and zones 54c and 53c of plates 52 and 51 come in contact with faces 38 and 36 of compensation bar 35. These zones 54c and 53c are shown in recess, which allows for a reduction of the effect of the resistance that the shock absorber is showing due to the return of plate 52.

The adjustment of the prestress of the principal spring can be assured in different ways. For example, as is shown in FIGS. 9 and 10, movable element 2, or first element of the energization element, is connected to the jaw of the binding by a linkage element, such as rod 39, whose length is adjustable, for example by screwing in a tapped bore of movable element 2. In the embodiment of FIG. 11, the principal spring 3 is connected to compensation bar 24 by a linkage element, such as a shaft or push button 77 whose length is adjustable, for example by screwing of a serrated wheel 78 which forms a support of the spring on the threaded end of shaft 77.

Figure 12:
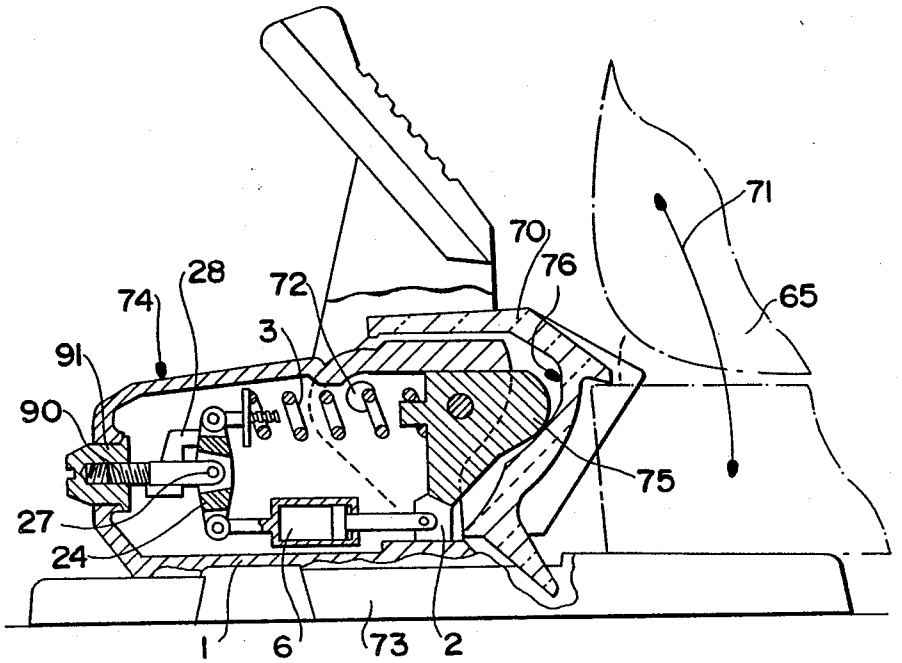
FIG. 12 shows an alternative embodiment of the rear binding which schematically illustrates a side view of a rear abutment provided with a tightening screw.

FIG. 12 shows an alternative embodiment wherein a tightening adjustment screw having threads 90 acts simultaneously on articulation axis 27 of compensation bar 24, and on abutment 28. The screwing or unscrewing of stopper or plug 91 thus produces a compression or decompression of the spring, which results in the tightening of the binding, as well as a variation of the length of shock absorber 6. This length variation has no appreciable influence on the action of the shock absorber because it reacts only to the speed of displacement and not the displacement. Furthermore, the limiting orientation of compensation bar 28 is not modified by the adjustment of the length because abutment 28 is simultaneously displaced with axis 27 of the compensation bar.

In FIGS. 13 to 16, the tightening adjustment is of essentially the same type, and the tightening screw acts on both the spring and the initial length of the shock absorber. The limiting orientation of compensation bar 35 is only modified in the case of a length adjustment because zones 55 and 55' of stable equilibrium are moving with any change in their orientation.

Although the invention has been described with reference to particular means, materials and embodiments it is to be understood that the invention is not limited to the particulars disclosed and extends to all equivalents within the scope of the claims.

I claim:

1. A safety binding for a ski boot comprising:

(a) a jaw for retaining a portion of said boot, and to release said portion of said boot under the effects of a force greater than an elastic return force, said jaw being movable between a stable equilibrium position and a release position in which said jaw releases said boot;

(b) an energization assembly comprising:

(i) elastic return means for exerting said elastic return force on said jaw to bias said jaw to said stable equilibrium position;

(ii) shock absorption means for absorbing shock; and (iii) means for varying said elastic return force as a function of intensity and duration of said force on said boot, whereby under an effect of a soft force said elastic return means and said shock absorption means act in parallel to define said elastic return force and return conditions of said jaw, while under an effect of a brief high force said elastic return means exerts an elastic return force on said jaw which has a magnitude greater than that due to said soft force, said means for varying said elastic return force comprising a compensation device operably associating said elastic return means and said shock absorption means.

2. The safety binding as defined by claim 1 wherein said elastic return means includes a longitudinal component of movement, and wherein said compensation device comprises a transverse compensation element oriented generally transverse to the direction of said longitudinal component of movement of said elastic return means.

3. The safety binding as defined by claim 2 further comprising a fixed element wherein said jaw is movable with respect to said fixed element.

4. The safety binding as defined by claim 3 wherein said fixed element is a base.

5. The safety binding as defined by claim 3 wherein said elastic return means comprises at least one principal spring.

6. The safety binding as defined by claim 5 further including means for mounting said jaw for pivoting with respect to said fixed element, said safety binding further comprising a movable element moved by said jaw as said jaw pivots.

7. The safety binding as defined by claim 6 wherein said at least one principal spring is positioned between said fixed element and said movable element.

8. The safety binding as defined by claim 7 further comprising abutment means for cooperating with said transverse compensation element to define a transverse limiting orientation of said transverse compensation element in a support position.

9. The safety binding as defined by claim 8 wherein said force exerted by said elastic return means comprises a force exerted by said at least one principal spring, and wherein said transverse compensation element is elastically biased towards said transverse limiting orientation against said force exerted by said at least one principal spring.

10. The safety binding as defined by claim 9 wherein said transverse compensation element remains in said transverse limiting orientation under the effect of a soft force, and is displaced from said support position against said abutment means, under an effect of a brief force to compress said at least one principal spring and increase the elastic return force exerted by said at least one principal spring on said jaw.

11. The safety binding as defined by claim 11 wherein a first end of said shock absorption means is connected to said fixed element.

12. The safety binding as defined by claim 11 wherein a first end of said at least one principal spring is connected to said fixed element.

13. The safety binding as defined by claim 12 wherein a second end of said shock absorption means is journalled to a first journal point on said transverse compensation element.

14. The safety binding as defined by claim 13 wherein said transverse compensation element is pivotable relative to a second end of said at least one principal spring at a second journal point on said transverse compensation element.

15. The safety binding as defined by claim 14 wherein said movable element is pivotably journalled at a third journal point relative to said transverse compensation element.

16. The safety binding as defined by claim 6 wherein a first end of said shock absorption means is connected to said movable element.

17. The safety binding as defined by claim 16 wherein a first end of said at least one principal spring is biased against said movable element.

18. The safety binding as defined by claim 17 wherein a second end of said shock absorption means is journalled to a first journal point of said transverse compensation element.

19. The safety binding element as defined by claim 18 wherein said transverse compensation element is pivotable relative to a second end of said at least one principal spring at a second journal point on said transverse compensation element.

20. The safety binding as defined by claim 19 wherein said transverse compensation element is journalled at a third journal point relative to said fixed element.

21. The safety binding as defined by claim 6 wherein said movable element is a shaft.

22. The safety binding as defined by claim 6 wherein said movable element is coupled to said jaw by a linkage element of adjustable length, said movable element being structurally related to said elastic return means whereby adjustment of the length of said linkage element adjusts the prestress of said elastic return means.

23. The safety binding as defined by claim 6 wherein said at least one principal spring and said shock absorption means transmit force exerted on said movable element in parallel to said compensation element during a soft force on said boot.

24. The safety binding as defined by claim 23 wherein said transverse compensation element is pivotably mounted on said fixed element, and wherein said transverse compensation element is biased against an abutment by said principal spring.

25. The safety binding as defined by claim 6 wherein said movable element is a shaft having one end associated with said jaw and biased by said elastic return means, said transverse compensation element pivotally secured to said shaft at an end opposite to said jaw and being biased into a normal operating position by said elastic return means, said transverse compensation element being pivotally secured to said shock absorption means to exert a force on said shock absorption means in response to a longitudinal displacement of said shaft against the bias of said elastic return means.

26. The safety binding as defined by claim 25 wherein said transverse compensation element includes a first ramp and a second ramp and said transverse compensation element is biased towards said normal operating position through said first ramp and said second ramp.

27. The safety binding as defined by claim 26 wherein said at least one principal spring is biased between said fixed element and a first plate, and wherein said transverse compensation element extends between said first plate and a second plate associated with said movable element, and wherein the pressure exerted by said first plate and said second plate on said transverse compensation element is sufficient to maintain said compensation means in a normal operating condition.

28. The safety binding as defined by claim 27 wherein said first plate comprises an inclined surface forming a third ramp, and said second plate comprises an inclined surface forming a fourth ramp, and each of said first plate and said second plate comprises a flat intermediate surface adapted to press against said transverse compensation element whereby exertion of a brief force on said movable element aligns said first ramp and said second ramp of said transverse compensation element, respectively, against said third ramp and said fourth ramp.

29. The safety binding as defined by claim 3 wherein said transverse compensation element is pivotably mounted at a journal point on an intermediate support, and wherein said fixed element further comprises an abutment means positioned for limiting rotation of said transverse compensation element in a direction that said transverse compensation element follows under the effect of said elastic return force exerted by said return means.

30. The safety binding as defined by claim 29 wherein said intermediate support is fixed in position with respect to said fixed element.

31. The safety binding as defined by claim 29 further comprising means for adjustably positioning said intermediate support with respect to said fixed element.

32. The safety binding as defined by claim 31 wherein said intermediate support is mounted on adjustment means for transversely adjusting the position of said intermediate support.

33. The safety binding as defined by claim 29 wherein said intermediate support has a surface and said transverse compensation element has a surface wherein at least one said surface is a ramp for varying the effect of the shock absorption means as a function of the rotation of the transverse compensation element.

34. The safety binding as defined by claim 1 wherein said shock absorption means has one end secured to a fixed element, and another end pivotally secured to an intermediate transverse element, wherein said intermediate transverse element is pivotally associated with a movable element adapted to move with said jaw, and wherein said elastic return means is a principal spring adapted to bias said jaw and said intermediate transverse element to a normal operating position.

35. The safety binding as defined by claim 34 wherein said intermediate transverse element has a surface comprising a first ramp, and said principal spring is pressed between a fixed element and said first ramp through a member located on said principal spring to bias said intermediate transverse element into a normal operating position.

36. The safety binding as defined by claim 35, wherein said intermediate transverse element has a surface comprising a third ramp on a side opposite said first ramp of said transverse compensation element adapted to cooperate with a fourth ramp of a member connected to said moveable element wherein said third ramp is adapted to be pressed against said fourth ramp during compression of said principal spring.

37. The safety binding as defined by claim 1 wherein said elastic return means is a principal spring, said principal spring and said shock absorption means are supported against a fixed element, and an opposite end of each of said principal spring and said shock absorption means are pivotably associated with a transverse intermediate element.

38. The safety binding as defined by claim 37 further comprising a movable element adapted to move with said jaw, wherein said movable element is in pivotable relationship with said transverse intermediate element, and wherein said movable element, said transverse intermediate element and said principal spring are positioned whereby a force exerted on said jaw is transmitted to said principal spring and said shock absorption means through said transverse intermediate element.

39. The safety binding as defined by claim 38 wherein said movable element comprises a first plate having an inclined ramp and a flat surface, and wherein said principal spring is associated with said transverse intermediate element through a second plate having an inclined ramp and a flat surface, whereby a portion of said transverse intermediate element is generally positioned between each said flat surface in a normal operating condition of said binding.

40. The safety binding as defined by claim 1 wherein said elastic return means is a principal spring and wherein said binding further comprises adjustment means for adjusting the prestress in said principal spring.

41. The safety binding as defined by claim 1 further comprising a transverse intermediate element extending between said shock absorption means and said elastic return means, and abutment means defining a limiting transverse orientation of said transverse intermediate element, said transverse intermediate element and said abutment means being longitudinally adjustable to adjust the prestress in said elastic return means when said binding is in a normal operating position.

42. The safety binding as defined by claim 1 wherein said safety binding is a rear step-in binding having a casing and said compensation device comprises a transverse compensating element pivotably secured to said elastic return means, said shock absorption means and the casing of the binding at three separate points of pivotal attachment.

43. The safety binding as defined by claim 42 wherein said transverse compensating element is pivotably secured to said casing at a point between said points of pivotable attachment to said elastic return means and said shock absorption means.

44. The safety binding as defined by claim 43 wherein said elastic return means is a principal spring having one end secured to said transverse compensating element, and another end secured to a spur in sliding contact with a ramp pivotably mounted on said casing.

45. The safety binding as defined by claim 44 wherein said spur comprises means for exerting a force on a movable element secured to said shock absorption means at an end opposite to a point of pivotable attachment of said shock absorption means to said transverse compensating element.

46. A safety binding for a ski boot comprising:

(a) a jaw for retaining a portion of a boot, and to release said portion of said boot under the effects of a force transmitted by said boot greater than an elastic return force, said jaw being movable between a stable equilibrium position and a release position in which said jaw releases said boot;

(b) an energization assembly comprising elastic return means and shock absorption means for varying said elastic return force as a function of the intensity and duration of the force transmitted by said boot, said elastic return means and said shock absorption means being associated through a compensation means whereby said energization assembly comprises means such that under the effect of a soft force said elastic return means and said shock absorption means act in parallel to define release and return conditions of the jaw, while under the effect of a brief force said elastic return means and said shock absorption means act in series and parallel on said elastic return means so as to increase said elastic return force exerted by said return means on said jaw.

47. A safety binding for a ski boot comprising:

(a) a jaw movable between a retention position, in which said ski boot is retained on said ski, and a release position, in which said ski boot is released from retention on said ski upon application of a force by said ski boot with respect to said jaw greater than a release threshold force;

(b) an energization assembly comprising:

(i) an elastic return element for exerting an elastic return force on said jaw for biasing said jaw toward said retention position;

(ii) a shock absorption means for absorbing shock; and (iii) a pivotally mounted compensation device operatively associating said elastic return element and said shock absorption means for enabling said elastic return force of said elastic return element to be varied as a function of intensity and duration of said force applied by said ski boot with respect to said jaw.

48. The safety binding of claim 47 wherein said compensation device is connected between said elastic return element and said shock absorption means, wherein said shock absorption means is configured to move between an extended position and a retracted position, wherein, in said extended position of said shock absorption means, said elastic return force of said elastic return element, which is said release threshold force which is to be overcome by said boot to release said boot from said safety binding, can be varied as a function of said intensity and duration of said force applied by said ski boot with respect to said jaw.

49. The safety binding of claim 48 wherein said compensation device is configured and arranged with respect to said elastic return element and said shock absorption means such that in response to a force of a first intensity and a first duration, said elastic return force is a first value and, in response to a force of a second intensity which is greater than said first intensity and a second duration which is less than said first duration, said elastic return force is varied to a second value which is greater than said first value.

50. The safety binding of claim 47 wherein said compensation device includes a bar having an intermediate pivot axis, wherein said elastic return element and said shock absorption means have respective portions which are connected to said bar on respective sides of said intermediate pivot axis.

* * * * *

UNITED STATES PATENT AND TRADEMARK OFFICE

CERTIFICATE OF CORRECTION

PATENT NO. : 4,940,253

DATED : July 10, 1990

INVENTOR(S) : Jean-Claude BRISCHOUX

It is certified that error appears in the above-identified patent and that said Letters Patent is hereby corrected as shown below:

In the Abstract, line 12 of the printed patent, change "whereby" to ---, whereby (1)---.

In the Abstract, line 13 of the printed patent, change ". The" to ---, the---.

In the Abstract, line 14 of the printed patent, delete "(1)" after "by".

In the Abstract, line 17 of the printed patent,change "violet" to ---violent---.

In column 6, line 2 of the printed patent, insert ---in--- after "shown".

In column 6, line 9 of the printed patent, insert ---of--- after "return".

In column 6, line 12 of the printed patent, change "enlarge" to ---enlarged---.

In column 6, line 41 of the printed patent, change "sloW" to ---slow---.

In column 11, line 17 of the printed patent, insert ---on--- before "both".

In column 12, line 35 of the printed patent, change "36" to ---35---.

In column 12, line 63 of the printed patent, change "it" to ---in---.

In column 13, line 1 of the printed patent, change "FIG." to ---FIGS.---.

UNITED STATES PATENT AND TRADEMARK OFFICE

CERTIFICATE OF CORRECTION

PATENT NO. : 4,940,253

DATED : July 10, 1990

INVENTOR(S) : Jean-Claude Brischoux

It is certified that error appears in the above-identified patent and that said Letters Patent is hereby corrected as shown below:

In column 15, line 1, claim 11, line 1 of the printed patent, change "claim 11" to ---claim 6---.

Signed and Sealed this

Twenty-sixth Day of May, 1992

*Attest:*

DOUGLAS B. COMER

*Attesting Officer*

*Acting Commissioner of Patents and Trademarks*